US009280129B2

(12) United States Patent
Shimizu et al.

(10) Patent No.: US 9,280,129 B2
(45) Date of Patent: Mar. 8, 2016

(54) DEVELOPER CARTRIDGE

(71) Applicant: Brother Kogyo Kabushiki Kaisha, Nagoya-shi, Aichi-ken (JP)

(72) Inventors: Keita Shimizu, Tsushima (JP); Satoru Ishikawa, Kitanagoya (JP); Soun Kanada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/546,206

(22) Filed: Nov. 18, 2014

(65) Prior Publication Data

US 2015/0139693 A1 May 21, 2015

(30) Foreign Application Priority Data

Nov. 18, 2013 (JP) ..... 2013-238355

(51) Int. Cl.
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 21/1676; G03G 21/1832; G03G 2215/0875; G03G 2215/0877
See application file for complete search history.

(56) References Cited

U.S. PATENT DOCUMENTS

| | | | | |
|---|---|---|---|---|
| 7,428,386 | B2 * | 9/2008 | Itabashi | 399/12 |
| 8,326,178 | B2 * | 12/2012 | Nakamura et al. | 399/114 |
| 8,676,086 | B2 | 3/2014 | Fujii | |
| 2011/0103835 | A1 * | 5/2011 | Hayashi et al. | 399/119 |
| 2011/0233093 | A1 | 9/2011 | Fujii | |
| 2014/0155237 | A1 | 6/2014 | Fujii | |

FOREIGN PATENT DOCUMENTS

JP 2011-203364 A 10/2011

* cited by examiner

*Primary Examiner* — Gregory H Curran
(74) *Attorney, Agent, or Firm* — Banner & Witcoff, Ltd.

(57) ABSTRACT

A developer cartridge has a rotatable body, a casing, a conveying guide structure, and a cover. The cover includes a facing part and a first covering part. The conveying guide structure includes a first conveying guide extending in the second direction, and a second conveying guide connected from the first conveying guide at an end on the other side of the second direction and extends toward the other side of the second direction so as to curve in the first direction with respect to the first conveying guide. The first covering part includes a first contacting part configured to contact the first conveying guide, and a second contacting part configured to curve in the first direction with respect to the first contacting part so as to extend toward the other side in the second direction, and contact the second conveying guide.

17 Claims, 10 Drawing Sheets

DEVELOPER CARTRIDGE

CROSS-REFERENCE TO RELATED APPLICATION

This application claims priority under 35 U.S.C. §119 from Japanese Patent Application No. 2013-238355 filed on Nov. 18, 2013. The entire subject matter of the application is incorporated herein by reference.

BACKGROUND

1. Technical Field

The present disclosures relate to a cartridge used in an image forming apparatus configured to form images in accordance with an electrophotographic image forming method.

2. Related Art

There has been known a printer having a cartridge which is detachably attached to a casing of the printer.

As an example of such a cartridge, there is known a developer cartridge which has a housing containing toner, and a developing roller configured to bear the toner on its circumferential surface.

The developer cartridge is typically configured such that the developing roller is rotatably supported by two opposing side walls of the housing, and a part of the circumferential surface of the developing roller is exposed to outside from the housing. Because of such a structure, when the developer cartridge is detached from the casing of the printer, the part of the circumferential surface of the developing roller may be damaged when the developer cartridge is shipped or conveyed. In order to prevent such a problem, a developing roller cover is generally provided to cover the exposed part of the developing roller when the developer cartridge is detached from the casing of the printer.

SUMMARY

Typically, the developing roller cover is configured to have a substantially U-shaped cross section which is attached to the housing of the developer cartridge such that upper and lower walls of the cover contact upper and lower surfaces of the housing, respectively, so that the developing roller is covered with a curved part (i.e., U-shaped part) of the developing roller cover. The developer cartridge configured as above is typically provided with ribs protruded downward to contact, when the developer cartridge is attached to the printer, a sheet conveyed inside the printer. Given that an upstream and a downstream with respect to a sheet conveying direction at the developer cartridge are referred to as a front side and a rear side of the printer, respectively, bottom surfaces of the ribs have substantially straight portions and curved portions connected to the front ends of the straight portions and curved toward the housing, respectively. Due to such a shape, a space is formed between the front end part of the developing roller cover and the developing roller housing. Because of such a space, the developer cartridge may be upsized when the developing roller cover is attached.

Further, in such a developer cartridge, when there exists a space between the housing and the developing roller cover, if an external force is applied to when being conveyed, the developing roller cover may elastically deformed to contact the housing, and the conveying ribs may be damaged.

In consideration of the above, aspects of the disclosure provide an improved developer cartridge of which the conveying ribs may not be damaged while the size will not upsized excessively when the developing roller cover is attached to the printer.

According to aspects of the disclosures, there is provided a developer cartridge, which has a rotatable body configured to be rotatable about a rotation axis extending in an axial direction and carry developer on a circumferential surface thereof, a casing configured to rotatably support the rotatable body so that a part of the circumferential surface of the rotatable body is exposed to outside the casing, the casing being configured to contain the developer therein, a conveying guide structure protruded from the casing on one side in a first direction which is perpendicular to the axial direction, the conveying guide structure being configured to guide a sheet medium when in use, and a cover configured to detachably attached to the casing to cover the part of the circumferential surface of the rotatable body. The cover includes a facing part arranged on one side in a second direction which is perpendicular to both the first direction and the axial direction with respect to the circumferential surface of the rotational body, the facing part facing the rotational body with a predetermined space therebetween, and a first covering part configured to cover the conveying guide structure from one side of the first direction, The conveying guide structure includes a first conveying guide extending in the second direction, and a second conveying guide connected from the first conveying guide at an end on the other side of the second direction and extends toward the other side of the second direction so as to curve in the first direction with respect to the first conveying guide. The first covering part includes a first contacting part configured to be connected to an end of the facing part on the one side of the first direction, extend toward the other side in the second direction and contact the first conveying guide, and a second contacting part configured to be connected the other end, in the second direction, of the first contacting part, curve in the first direction with respect to the first contacting part so as to extend toward the other side in the second direction, and contact the second conveying guide.

According to further aspects of the disclosures, there is provided a developing cartridge which has a developing roller, a casing disposed the developing roller so that a part of the circumferential surface of the developing roller is exposed to outside the casing, the casing being, a conveying rib protruded from the casing in a first direction, the conveying rib being configured to guide a sheet medium, and a cover configured to detachably attached to the casing to cover the part of the circumferential surface of the developing roller. The cover is provided with a facing part facing the rotational body with a predetermined space, and a first covering part configured to cover the conveying rib. In this configuration, the conveying rib has a first guide, and a second guide connected from the first guide and extends in a second direction which is perpendicular to the axial direction so as to curve with respect to the first guide. Further, the first covering part has a first contacting part connected to an end of the facing part and contacting a tip of the first guide, and ka second contacting part connected the first contacting part, the second contacting part contacting a tip of the second guide, a second contacting part extending in the second direction so as to curve with respect to the first covering part.

BRIEF DESCRIPTION OF THE ACCOMPANYING DRAWINGS

DETAILED DESCRIPTION OF THE ILLUSTRATIVE EMBODIMENTS

Overview of Developer Cartridge

Figure 1:
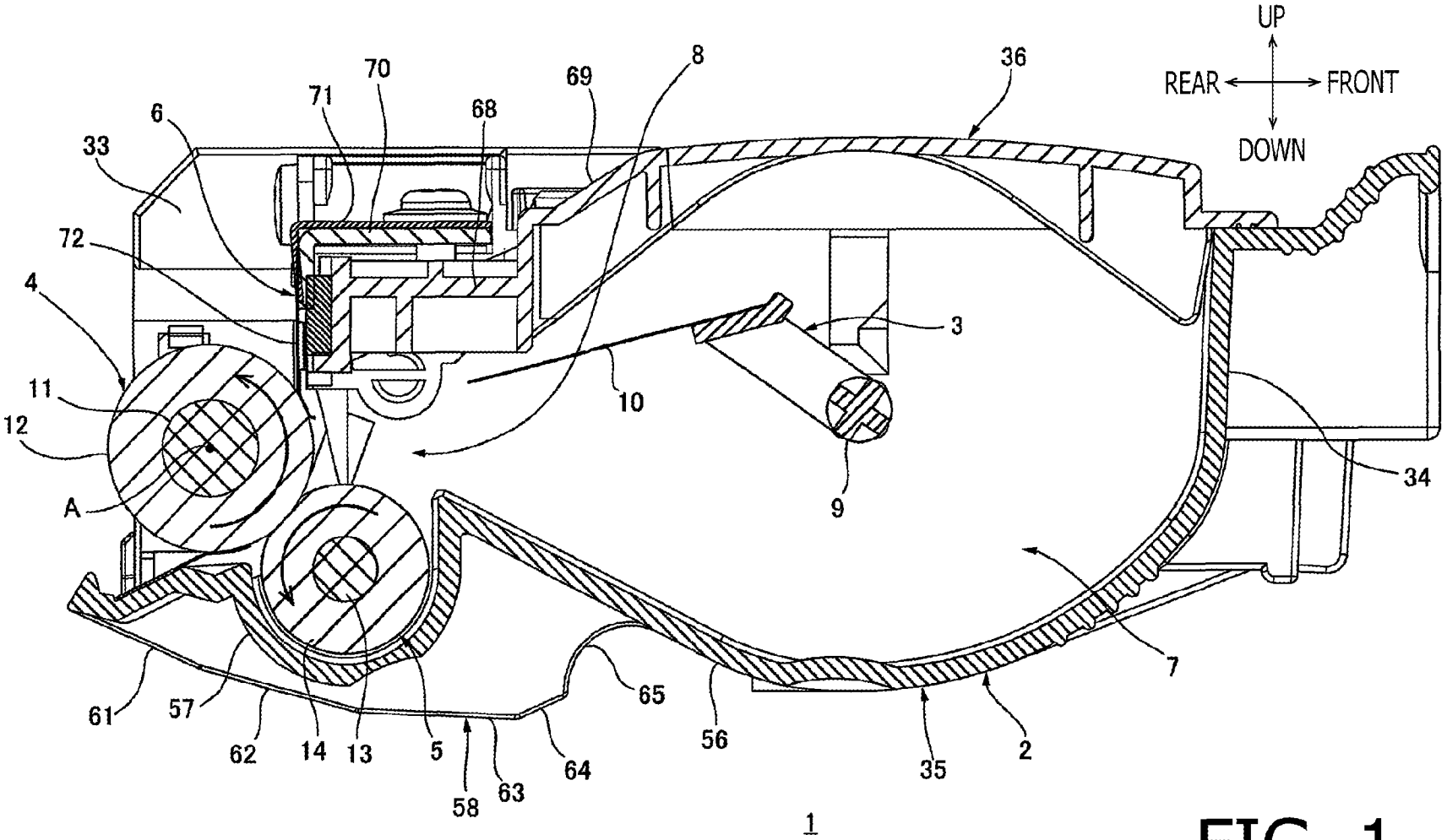
FIG. 1 is a cross-sectional side view of a developer cartridge according to a first illustrative embodiment of the disclosures.

As shown in FIG. 1, a developer cartridge 1 according to aspects of the present disclosure has a developer frame 2 which is a housing of the developer, an agitator 3, a developing roller 4, a supply roller 5 and a thickness regulation blade 6.

It is noted that various connections are set forth between elements in the following description. It is noted that these connections in general and, unless specified otherwise, may be direct or indirect and that this specification is not intended to be limiting in this respect.

In the following description, when directions of the developing cartridge 1 are referred to, a direction where the developing roller 4 is arranged will be referred to as a rear direction of the developer cartridge 4, and the opposite direction will be referred to as a front direction of the developer cartridge 1. In other words, a left-hand side of FIG. 1 is a rear side of the developer cartridge 1, and a right-hand side of FIG. 1 is a front side of the developer cartridge 1. Further, as shown in FIG. 1, an upside of FIG. 1 is an upside of the developer cartridge 1, while a down side of FIG. 1 of FIG. 1 is a down side of the developer cartridge 1. Right and left sides of the developer cartridge 1 are defined when the developer cartridge 1 is viewed from the front side. In other words, a closer side with respect to a plane of FIG. 1 is a left side of the developer cartridge 1, while a farther side with respect to the plane of FIG. 1 a right side of the developer cartridge 1. The above-described directions are indicated by arrows in the accompanying drawings.

The developer frame 2 has a substantially cuboids shape extending in the right-and-left direction. A rear end of the developer frame 2 is opened toward the rear side. According to the illustrative embodiments, toner is employed as the developer. The developer frame 2 has therein a toner chamber 7 and a developer chamber 8 which are arranged in the front-and-rear direction.

The agitator 3 is rotatably supported at about a central portion, in the front-and-rear and up-and-down directions, inside the toner chamber 7. The agitator 3 is provided with an agitator shaft 9 which has a substantially cylindrical shape extending in the right-and-left direction, and agitating blades 10.

The developer roller 4 is rotatably supported at a rear portion inside the developer chamber 8 about a rotary axis A. The developer roller 4 has a developer roller shaft 11 which has a substantially cylindrical shape extending in the right-and-left direction, and a developer roller body 12 which coats a substantially central part, in the right-and-left direction, of the developer roller 11. An upper portion and a rear portion of the developer roller body 12 are exposed to outside from the developer frame 2.

The supply roller 5 is rotatably supported inside the developer chamber 8 at a lower front portion of the developer roller 4. The supply roller 5 has a supply roller shaft 13 which has a substantially cylindrical shape extending in the right-and-left direction, and a supply roller body 14 which coats a central portion, in the right-and-left direction, of the supply roller shaft 13. An upper rear portion of the supply roller body 14 is press-contacted with a lower front portion of the developer roller body 12 of the developer roller 4.

The thickness regulation blade 6 is arranged inside the developer chamber 8, at an upper front portion with respect to the developer roller 4. The thickness regulation blade 6 has a first holding member 70 which has an L-shaped cross section having a longer part extending in the right-and-left direction, a second holding member 71 which also has an L-shaped cross section having a longer part also in the right-and-left direction, and a blade member 72 which is sandwiched by the first holding member 70 and the second holding member 71 and extends in the up-and-down direction.

Overall Configuration of Printer

Figure 2:
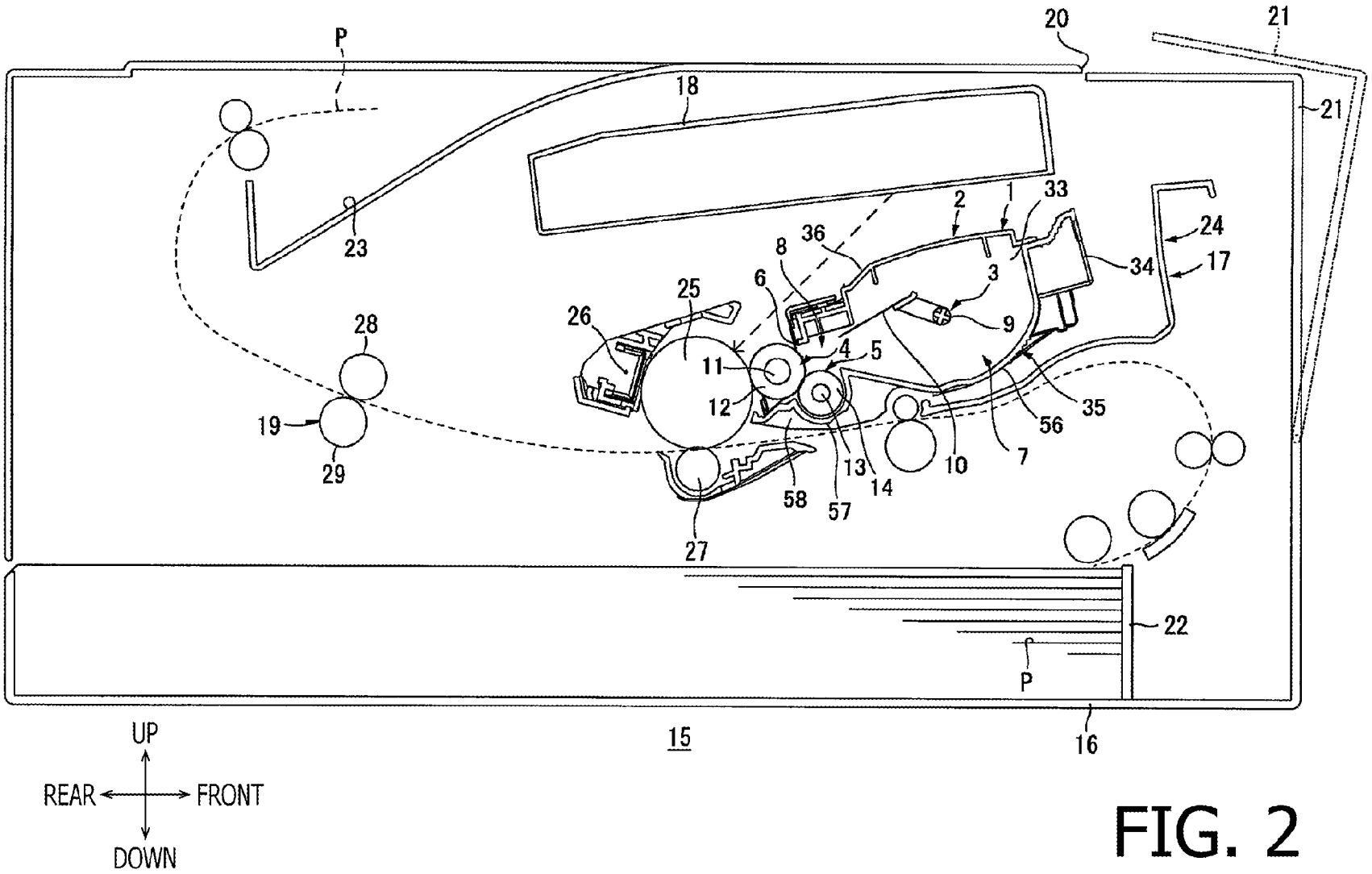
FIG. 2 is a cross-sectional side view of an image forming apparatus to which the developer cartridge shown in FIG. 1 is attached according to a first embodiment.

The developer cartridge 1 described above are implemented in a printer 15 as shown in FIG. 2.

According to the illustrative embodiment, the printer 15 is a printer for forming monochromatic images in accordance with the electrophotographic imaging method. The printer 15 has a casing 16, a process cartridge 17, a scanner unit 18 and a fixing unit 19.

The casing 16 has a cuboids box-like shape. The casing 16 has an opening 20, a front cover 21, a sheet supply tray 22 and a sheet discharge tray 23.

The opening 20 is formed to penetrates through a front opening of the casing 17. The process cartridge 17 is configured to carried through the opening when attached to and removed from the casing 16.

The front cover 21 is configured to open or close the opening 20. The sheet supply tray 21 is arranged at a bottom portion inside the casing 16, and is configured to accommodate a plurality of sheets of a recording medium (e.g., a plurality of printing sheets) P. The discharge tray 23 is defined on an upper surface of the casing 16.

The process cartridge 17 is attached to or detached from the casing 16 through the opening 16. The process cartridge 17 includes a drum cartridge 24 and the developer cartridge 1.

The drum cartridge 24 accommodates a photoconductive drum 25, a scorotron type charger 26, and a transfer roller 27.

The photoconductive drum 25 is arranged at a rear portion of the drum cartridge 24. The photoconductive drum 25 is rotatably supported by a frame of the drum cartridge 25.

The scorotron type charge 26 is arranged on a rear side of the photoconductive drum 26 and spaced therefrom.

The transfer roller 27 is arranged below the photoconductive drum 25. The transfer roller 27 contacts a lower part of the photoconductive drum 25.

The developer cartridge 1 is configured to be attached to and detached from the drum cartridge 24. When the developer cartridge 1 is attached to the drum cartridge 24, a rear part of the developing roller 4 contacts a front part of the photoconductive drum 25.

The scanner unit 18 is arranged above the process cartridge 17. The scanner unit 18 configured to emit a laser beam modulated based on image data toward the photoconductive drum 15 as indicated by dotted lines in FIG. 2.

The fixing unit 19 is arranged on a rear side of the process cartridge 17. The fixing unit 19 is provided with a heat roller 28 and a pressure roller 29. The pressure roller 29 is arranged on a lower rear sided with respect to the heat roller 28 and is press-contacted to a lower rear part of the heat roller 28.

When the printer 15 start an image formation process, under a control of a control unit (not shown), the scorotron type charger 26 uniformly charged a circumferential surface of the photoconductive drum 25. Thereafter, the scanner unit 18 emits the laser beam onto the circumferential surface of the photoconductive drum 25, thereby an electrostatic latent image based on the image data is formed on the circumferential surface of the photoconductive drum 25.

The supply roller 5 is configured to supply the toner inside the developer frame 2 to the photoconductive drum 4. With this configuration, the toner is positively charged by frictional electrification between the developing roller 4 and the supply roller 9, and thereafter supplied to the photoconductive drum 4. The thickness regulation blade 6 regulates the thickness of the toner on the developing roller 4 (i.e., keeps the thickness of the toner on the developing roller 4 to a predetermined thickness).

The developing roller 4 supplies the toner, of which thickness is kept to the predetermined thickness, to the circumferential surface of the photoconductive drum 25 where the electrostatic latent image is formed. With this operation, the latent image is developed (i.e., a toner image is borne by the photoconductive drum 25).

The printing sheet P is supplied one by one, at a predetermined timing, from the sheet supply tray 22 as rollers rotate, and fed to a position between the photoconductive drum 25 and the transfer roller 27 as guided by feeding ribs 58 provided to the developer cartridge. The toner image borne by the photoconductive drum 25 is transferred to the sheet P when the sheet passes the position between the photoconductive drum 25 and the transfer roller 27.

Thereafter, the heat roller 28 and the pressure roller 29 apply heat and pressure to the printing sheet P which passes through a nip therebetween. With this configuration, the toner image transferred on the printing sheet P is fixed on the printing sheet P.

Details of Developer Cartridge

Figure 3:
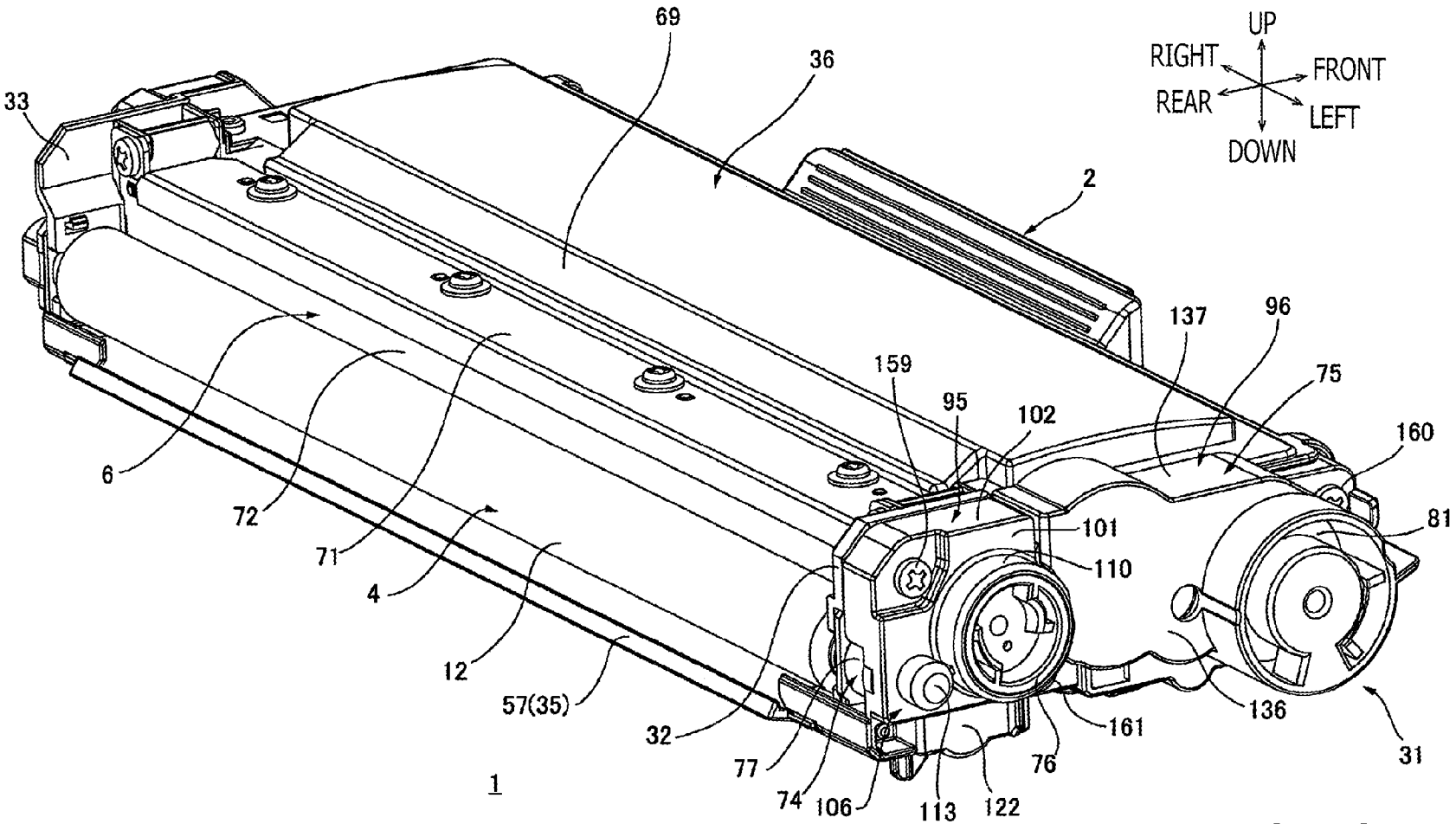
FIG. 3 is a perspective view of the developer cartridge from an upper left position with respect to the developer cartridge according to the first embodiment.

The developer cartridge 1 has the developer frame 2 and a driving unit 31 as shown in FIG. 3.

Figure 8:
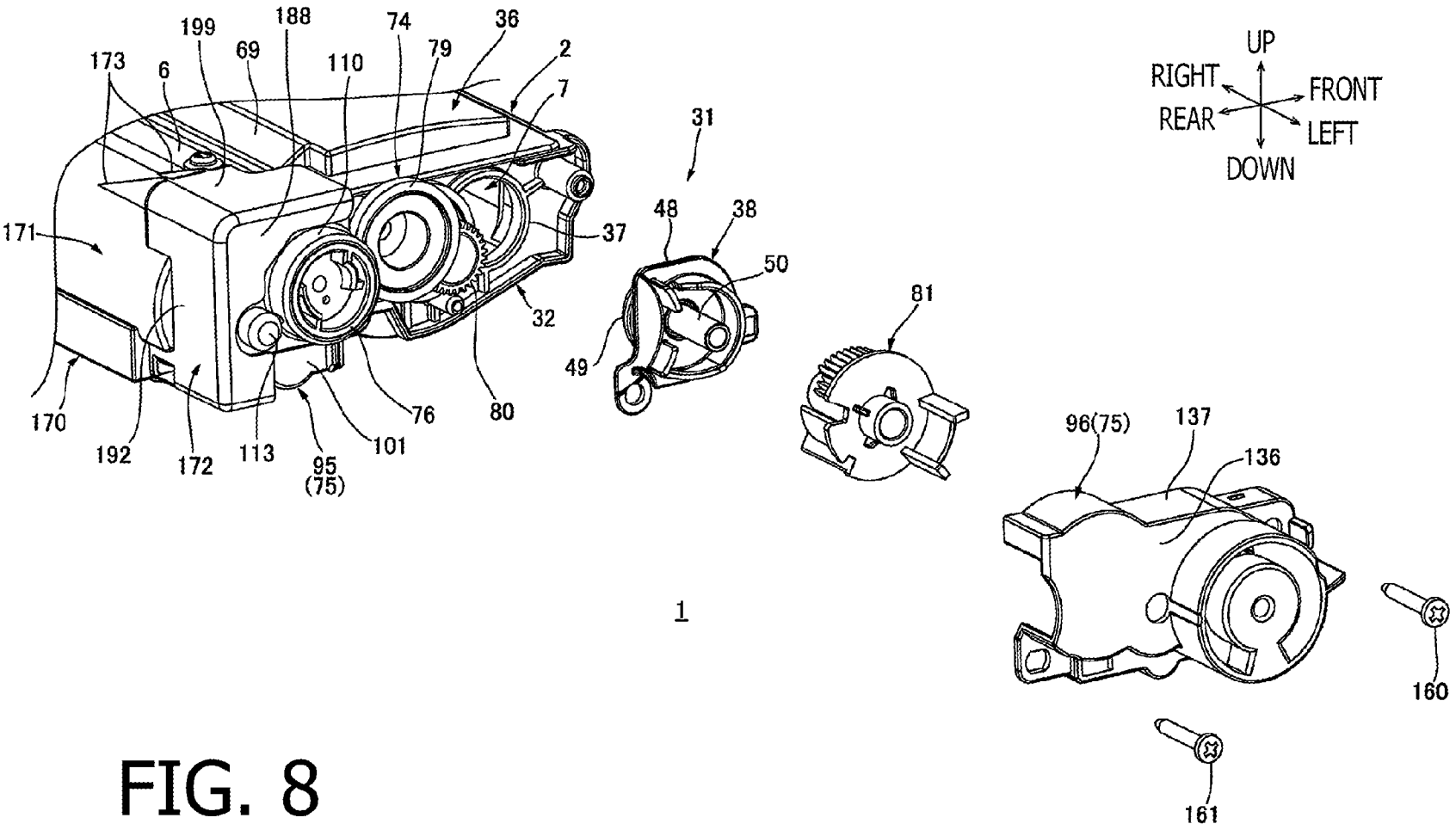
FIG. 8 is a perspective view of the developer cartridge shown in 4, when the developing roller cartridge is attached, whole a second cover is removed, according to a second embodiment.

The developer from 2 has a left wall 32, a right wall 33, a front wall 34, a bottom wall 35 and an upper wall 36. The left wall 32 is arranged on a left end portion of the developer frame 2. The left wall 32 is a plate-like member extending in the front-and-rear direction, and having a rectangular shape when viewed from the side. As shown in FIG. 8, a toner filling opening 37 is formed on the left wall 32, and a cap 38 for covering the filling opening 37 is provided.

A toner filling mouth 37 is arranged at a front portion of the left wall 32. The toner filling mouth 37 includes an opening which has a circular shape viewed from the right-and-left direction and penetrates through the left wall 32, and a cylindrical portion which defines the opening of the toner filling mouth 37 and protrudes leftward from the periphery of the opening of the toner filling mouth 37.

The cap 38 has a closing part 48, an insertion part 49 and a detection gear supporting shaft 50.

The closing part 48 is a plate-like member having a rectangular shape viewed in the right-and-left direction. The insertion part 49 is arranged on a right surface of the closing part 48. The insertion part 49 has a substantially cylindrical shape protruded rightward from the right surface of the closing part 49. An outer diameter of the insertion part 49 is slightly smaller than an inner diameter of the toner filling mouth 37.

The detection gear supporting shaft 50 is arranged on a left surface of the closing part 48. The gear supporting shaft 50 has a substantially cylindrical shape protruding leftward from the left surface of the closing part 48.

The cap 38 is attached to the left wall 32 as the insertion part 49 is inserted in the toner filling mouth 37. With this structure, the closing part 48 covers the toner insertion mouth 37 from the left side.

As shown in FIGS. 1 and 3, the right wall 33 is arranged at a right end portion of the developer frame 2. The right wall 33 has a plate-like member having a substantially rectangular shape viewed from the right-and-left direction and extending in the front-and-rear direction, similar to the left wall 32.

Figure 6:
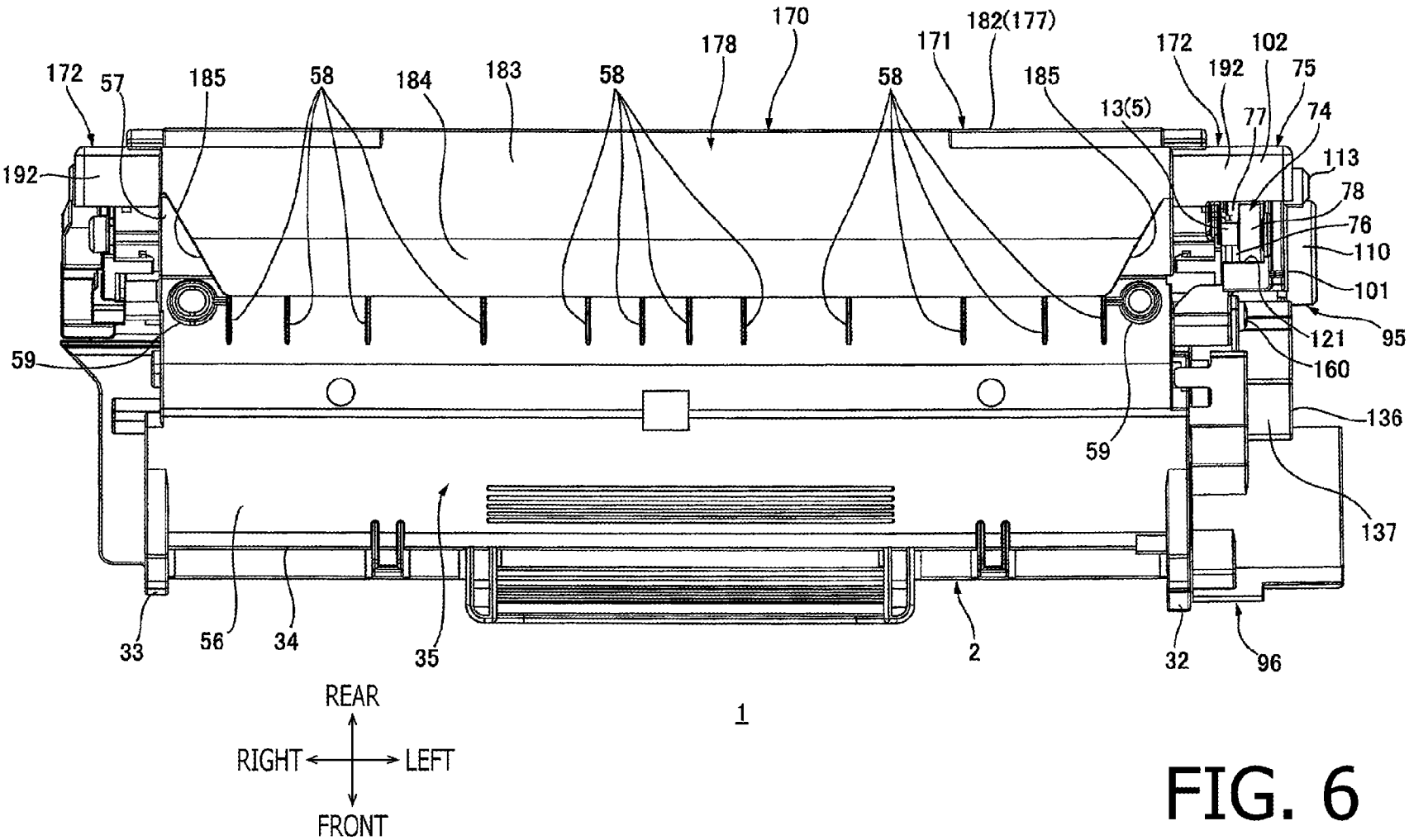
FIG. 6 is a bottom view of the developer cartridge shown in FIG. 4, when the developing roller cover is attached, according to the first embodiment.

The front wall 34 is arranged to bridge between the front end part of the left wall 32 and the front end part of the right wall 33, as shown in FIGS. 1 and 6. The front wall 34 has a plate-like shape extending in the right-and-left direction.

The bottom wall 35 is arranged to bridge between the lower end part of the left wall 32 and the lower end part of the right wall 33. The bottom wall 35 is a plate member which is curved from the lower end part of the front wall 34 toward rear side. The bottom wall 35 has a gently bent wall 56, a curved wall 57, a plurality of ribs 58 and a pair of positioning parts 59. There are 12 conveying ribs according to the first embodiment.

The bent wall 56 is connected to the lower end part of the front wall 34 and extends rearward from a central part of the lower wall 35. The gently bent wall 56 has a substantially arc shape viewed in the right-and-left direction corresponding to a trajectory of the agitator 3 which rotates about an axis extending in the right-and-left direction.

The curved wall 57 is substantially W-shaped cross-sectional side view which is a rear part of the bottom wall 35 connected from a rear end of the bent wall 56. The front part of the curved wall 57 is substantially arc shaped to meet locus of rotation of the supply roller 5. The rear part of the curved wall 57 is substantially straight and extends rearward.

Figure 5:
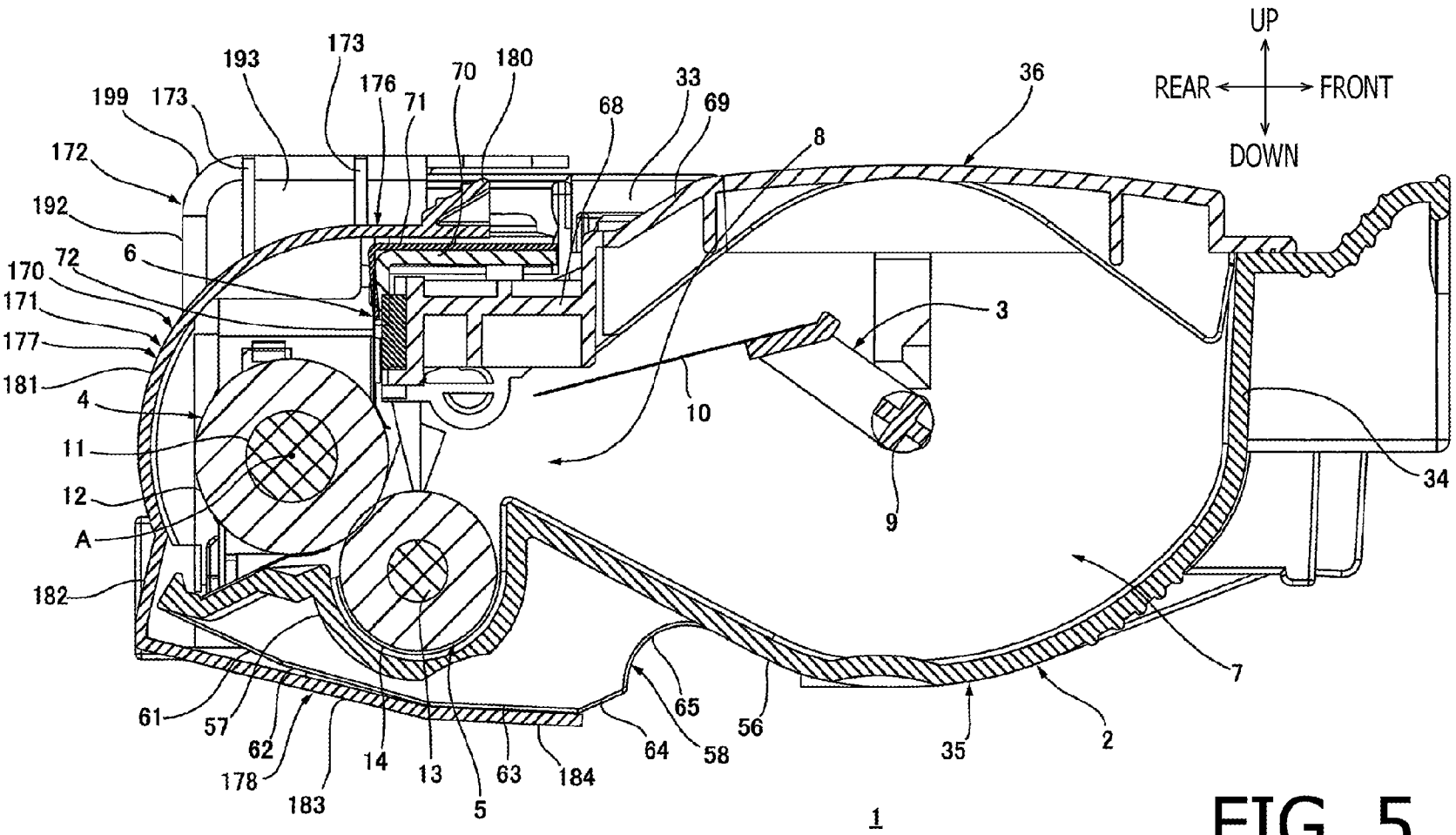
FIG. 5 is a cross-sectional side view of the developer cartridge shown in FIG. 4, when the developing roller cover is attached, according to the first embodiment.

The twelve conveying ribs 58 are configured to guide the sheet P which is conveyed toward the position between the photoconductive drum 25 and the transfer roller 27 when the developer cartridge 1 is attached to the casing 16 as shown in FIG. 2. The twelve conveying ribs 58 are arranged in the right-and-left direction and space from each other in the right-and-left direction as shown in FIGS. 1 and 6. Each conveying rib 58 has a plate-like shape and protruding downward from the lower surface of the front end part of the bottom wall 35. The rear end part of each conveying rib 58 is connected to the rear end part of the curved wall 57, which the front end part of each conveying rib 58 is connected to the rear end part of the bent wall 56. Specifically, each conveying rib 58 has a first surface 61, a second surface 62, a third surface 63, a fourth surface 64 and a fifth surface 65 as shown in FIG. 5.

The first surface 61 is defined as a lower surface at a rear end part of each conveying rib 58. The first surface 61 is connected with the rear end part of the curved wall 57, and configured to incline downward toward a front side thereof.

The second surface 62 is defined as a lower surface at a rear part of each conveying rib 58. The second surface 62 is connected with the front end of the first surface 61, and configured to incline downward from the rear part thereof toward the front part thereof so as to be less inclined than the first surface 61.

The third surface 63 is defined as a lower surface of each conveying rib 58 connected from the front end of the second surface 62. The third surface 63 is connected from the front end of the second surface 62 and extends substantially in the front-and-rear direction.

The fourth surface 64 is defined as a lower surface of a front part of each conveying rib 58. The fourth surface 64 is connected from the front end of the third surface 63 and configured to incline upward from the rear part thereof to the front part thereof.

The fifth part 65 is defined as a lower surface of each conveying rib 58 at a front end part thereof. The fifth surface 65 is connected from the front end of the fourth surface 64 and curved upward such that the fifth surface 65 is substantially arc-shaped when viewed in the right-and-left direction. The front end part of the fifth surface is connected to the lower surface of the rear part of the bent wall 56.

The pair of positioning parts 59 are provided to be used for positioning during a manufacturing process. The pair of positioning parts 59 are arranged next to and on out sides of the right and left end conveying ribs 58, respectively. Each of the positioning parts 59 has a substantially cylindrical shape extending downward from the lower surface at the rear end part of the bent wall 56 of the loser wall 35.

The upper wall 36 is arranged above an upper end of the right wall 33 and an upper end of the right wall 33, and an upper end of the front wall 34 as shown in FIGS. 1 and 3. The upper wall 36 is a substantially plate-like member extending in the right-and-left direction. The upper wall 36 has a blade supporting wall 68 and an inclined wall 69.

The blade supporting wall 68 is arranged at a rear end part of the upper wall 36 as shown in FIG. 1. The blade supporting wall 68 is substantially plate-shaped and has a rectangular shape extending in the right-and-left direction when viewed from the above. A rear surface of the blade supporting wall 68 extends in the up-and-down direction when viewed from the right-and-left direction, while an upper surface of the blade supporting wall 68 extends in the front-and-rear direction when viewed in the right-and-left direction. Along the rear surface and the upper surface of the blade supporting wall 68, the thickness regulating blade 6 is arranged.

The inclined wall 69 is connected from the front end of the blade supporting wall 68 and inclines upward toward the substantially central part, in the front-and-rear direction, of the upper wall 36. In other words, when a developing roller cover (described later) 170 is attached to the developer frame 2, the inclined wall 69 inclines downward from the central part, in the front-and-rear direction, of the upper wall 36 toward a griping part 180 of the developing roller cover 170.

The upper wall 36 is secured such that peripheral portion thereof except for the blade supporting wall 68 is secured to the upper part of the left wall 32, the upper part of the right wall 33 and the upper part of the front wall 34 by means of adhesion or the like.

The driving unit 31 is arranged on the left side of the left wall 32 as shown in FIGS. 6 and 8. The driving unit 31 includes a gear train 74 and a gear cover 75. The gear train 74 includes a coupling 76, a developing roller driving gear 77, a supply roller driving gear 78, an idle gear 79, an agitator driving gear 80 and a detection gear 81.

The coupling 76 is rotatably supported at a rear part on the left surface of the left wall 32 as shown in FIG. 3. The coupling 76 has a substantially cylindrical shape extending in the right-and-left direction. Although not shown in the drawings, the coupling 76 has a gear on the circumferential surface of a right side portion thereof.

The developing roller driving gear 77 is configured to transmits a driving force input from a not-shown drive source to the developing roller 4 through the coupling 76. The developing roller driving roller 77 is arrange on a rear side of the coupling as shown in FIGS. 3 and 6, and secured to a left end part of the developing roller shaft 11 so as not to be rotatable relative thereto. A front end part of the developing roller driving gear 77 engages with a rear end part of the right side of the coupling 76.

The supply roller driving gear 78 is arranged on a lower rear side of the coupling 76, and is secured to the left end part of the supply roller shaft 13 so as not to be rotatable relative thereto. The upper end part of the supply gear 78 engages with a lower rear part of the right portion of the coupling 76.

The idle gear 79 is rotatably supported at a position in front of the coupling 76 as shown in FIG. 8. The idle gear 79 is a multiple-stage gear having a large-diameter gear, a small-diameter gear and intermediate section connecting the large-diameter gear and the small-diameter gear. The rear end part of the large-diameter gear of the idle gear 79 engages with a front end of the right side part of the coupling 76.

The agitator gear 80 is rotatably supported at a lower front position of the idle gear 79. The agitator gear 80 is a two-stage gear having a large-diameter gear and a small-diameter gear. The upper rear part of the large-diameter gear of the agitator gear 80 engages with the lower front end part of the small-diameter gear of the idle gear 79.

The detection gear 81 is arranged on a front side of the agitator gear 80. The detection gear 81 is supported to be rotatable about the detection gear supporting shaft 50 of the cap 38. The detection gear 81 extends in the right-and-left direction. The left end part of the detection gear 81 has a substantially cylindrical shape of which the left end is closed. On the circumferential surface, over about a half portion, gear teeth are provided. That is, the detection gear 81 a partially toothed gear. The rear end part of the detection gear 81 is configured to engage with the front end part of the small-diameter gear of the agitator gear 80.

The gear cover 75 is attached to the left wall 32 so as to cover the gear train 74 collectively as shown in FIGS. 3 and 8. The gear cover 75 has a first gear cover 95 and a second gear cover 96.

The first gear cover 95 integrally has a first base plate 101 and a first peripheral wall 102 which protrudes rightward from a periphery of the first base plate 101. That is, the first gear cover 95 has a substantially box-like shape, a right end thereof being opened and a left end thereof being closed. The first gear cover 95 has a sufficient size to collectively cover both the coupling 76, the developing roller driving gear 77 and the supply roller driving gear 78. The first gear cover 95 has a coupling insertion part 110, a collar part 113 and a cutout part 121.

The coupling insertion part 110 is formed at a substantially central part, in the up-and-down and front-and-rear direction, of the first base plate 101. The coupling insertion part 110 is formed to penetrate the first base plate 101. The coupling insertion part 110 has a substantially circular shape when viewed in the right-and-left direction, and a cylindrical portion protruded leftward from the periphery thereof.

The collar part 113 is arranged at a substantially central part in the up-and-down direction and a rear part of the first base plate 101, and on a rear side of the coupling insertion part 110. The collar part 113 is configured to penetrate the first base plate 101. The collar part 113 has a substantially circular shape when viewed from the right-and-left direction, and a cylindrical portion protruded leftward from the periphery thereof, the left end of the cylindrical portion being closed. An inner diameter of the collar part 113 is slightly larger than the outer diameter of the developing roller shaft 11.

The cutout part 121 is formed such that a portion below the coupling insertion part 110, and a substantially central part in the front-and rear direction of a lower portion of the first peripheral wall 102 is cut out as shown in FIG. 6.

The second gear cover 96 is a part of the gear cover 75 and is configured to be separated from the first gear cover 95 as shown in FIGS. 6 and 8. The second gear cover 96 integrally has a second base plate 136, a second peripheral wall 137 which protrudes rightward from the peripheral end of the second based plate 136. That is, the second gear cover 96 is configured to have a box-like shape of which the right end part is opened, while the left end part is closed. The second gear cover 96 has a sufficient size to collectively cover the idle gear 76, the agitator gear 80 and the detection gear 81. Further, the second gear cover 96 also covers the toner filling mouth 37 in which the cap 38 supporting the detection gear 81 is inserted.

Attaching of Gear Cover to Left Wall

The gear cover 75 described above is attached to the left wall 32 by a worker.

In order to attach the gear cover 75 to the left wall 32, firstly the first gear cover 95 is attached to the left wall 32 to which the gear train 75 has already been attached as shown in FIG. 3. Specifically, the first gear cover 95 is attached to the left wall 32 from the left side thereof such that the collar part 113 receives the developing roller shaft 11 and the coupling insertion part 110 receives the left part of the coupling 76. Then, the first gear cover 95 is fixed to the left wall 32 with a first screw 159 being fastened.

With the above operation, the first gear cover 95 is attached to the left wall 32 so that the coupling 76, the developing roller driving gear 77 and the supply roller driving gear 78 are covered with the first gear cover 95.

Next, the second gear cover 96 is attached to the left wall 32 from the left side as shown in FIG. 8. Then, the second gear cover 96 is fixed to the left wall with a second screw 160 being fastened. The second gear cover 96 and the first gear cover 95 are both fixed to the left wall 32 with a co-fastening screw 161 being fastened.

With the above-described operation, the second gear cover 96 is attached to the left wall 32 so as to cover the agitator gear 80 and the cap 38. According to the above-described operations, the developer cartridge 1 can be assembled.

Developing Roller Cover

Figure 4:
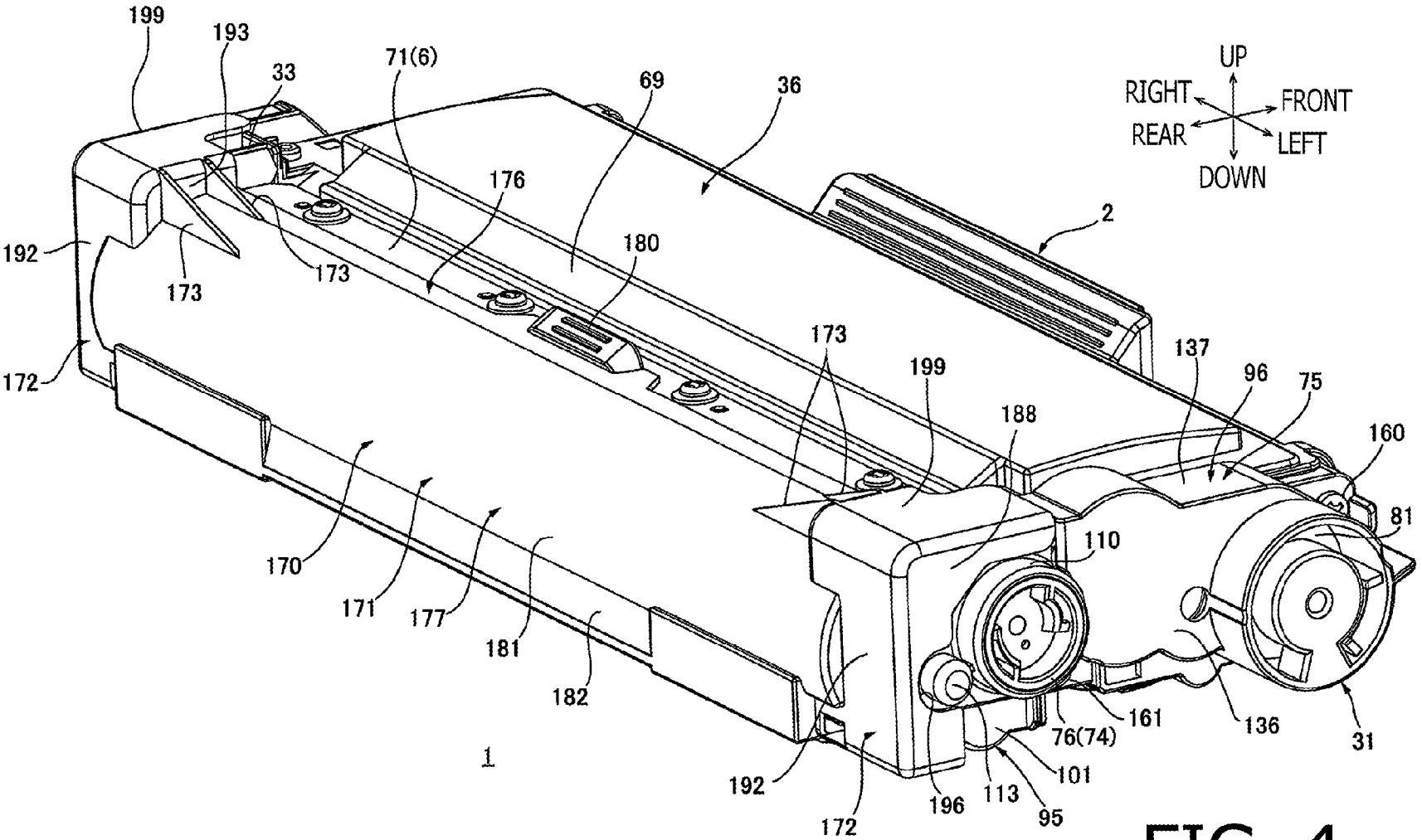
FIG. 4 is a perspective view of the developer cartridge to which a developing roller cover is attached, according to the first embodiment.

When the developer cartridge 1 is shipped/conveyed, the developing roller cover 170 is attached to the frame 2 of the developer cartridge as shown in FIGS. 4 and 5 in order to protect the developing roller 4 exposed at a rear end part of the frame 2.

The developing roller cover 170 is made of resin material (e.g., polypropylene), and formed to integrally include a main part 171, a pair of side covering parts 172 and inclined ribs 173. The main part 171 has a U-shaped cross sectional side view, and provided with facing part 177, an upper covering part 176 and a lower covering part 178. The facing part 177 is a substantially central portion in the up-and-down direction of the main part 171, and includes a curved part 181 and a planar part 182.

The curved part 181 has a C-shaped cross sectional side view which is curved toward the rear side such that it extends along the circumferential surface of the developing roller body 12 of the developing roller 4. The curved part 181 has a substantially cylindrical shape extending in the right-and-left direction.

The planar part 182 extends downward from the lower end of the curved part 181. The planar part 182 has a substantially rectangular shape extending in the right-and-left direction when viewed from the rear side.

The upper cover part 176 is an upper part of the main part 171 and extends frontward from the upper end of the curved part 181. The upper cover part 176 has a substantially rectangular shape when viewed from the up-and-down direction and extends in the right-and-left direction. The upper cover part 176 includes the gripping part 180.

The gripping part 180 is formed to protrude upward at a central portion, in the right-and-left direction, of the upper cover 176. The gripping part 180 has a V-shaped cross sectional side view, an opened portion directed frontward.

The lower cover 178 is a lower part of the main part 171 and extends frontward from the lower end of the planar part 182. The lower cover 178 is a plate-like portion having a rectangular shape extending in the right-and-left direction when viewed in the up-and-down direction. The lower cover 178 has a first contact part 183 and the second contact part 184.

The first contact part 183 is defined as a rear side portion of the lower cover 178, and bent to direct frontward from the lower end of the planar part 182. The first contact part 183 is configured to incline downward toward the front side thereof.

The second contact part 184 is defined as a front side portion of the lower cover 178, and bent to direct frontward from the front end of the first contact part. The second contact part 184 extends in the substantially front-and-rear direction. That is, the second contact part 184 extends substantially in parallel with the upper cover 176.

The lower cover 178 is formed with escaping parts 185 as shown in FIG. 6. The escaping parts 185 are formed by cutting out both ends, in the right-and-left direction, of the lower cover 178 from substantially the central position, in the front-and-rear direction, of the ends of the lower cover 178 in the right-and-left direction, to inward positions, in the right-and-left direction, of the front end of the second contact part 184.

A pair of side covering parts 172 are arranged at both sides, in the right-and-left direction, of the developing roller cover 170 as shown in FIGS. 4 and 6, and connected from the both ends of the main part 171, respectively. Each of the side covering parts 172 has a side wall 188, a peripheral wall 192 and a connection wall 193.

The side wall 188 is arranged on an outer end, in the right-and-left direction, of the side covering parts 172. The side wall 188 is a plate-like part having a substantially rectangular shape when viewed in the right-and-left direction and extends in the up-and-down and front-and-rear directions.

The peripheral wall 192 is a plate-like member having a U shape connected from the upper end, the rear end of the side wall 188 and extending in the right-and-left direction when viewed in the right-and-left direction.

The connection wall 193 is configured to connect an inner end, in the right-and-left direction, of the upper part of the peripheral wall 192 with the upper part of the curved portion 181 of the main part 171, and an outer end, in the right-and-left direction, of the upper cover part 176. The connection wall 193 has a rectangular shape when viewed in the right-and-left direction.

The side covering part 172 on the left side has a gear cover exposing unit 196. The gear cover exposing unit 196 is U-shaped when viewed in the right-and-left direction, which is recessed rearward from the front end of the side wall 188 of the left-side side covering part 172. The gear cover exposing unit 196 has a sufficient size to receive the coupling insertion part 110 and the collar part 113 collectively.

The side covering part 172 is configured such that an upper part from the upper cover part 176 is defined as a protruded part 199. That is, a pair of protruded parts 199 are provided to protrude in a direction away from the frame 2 in the developer cartridge 1 in which the developing roller cover 170 is attached. Further, the upper end of each protruded part 199 is arranged above the upper end of the gripping part 180. In other words, the upper end of the gripping part 180 is arranged to be lower than the upper ends of the protruded parts 199.

Figure 7:
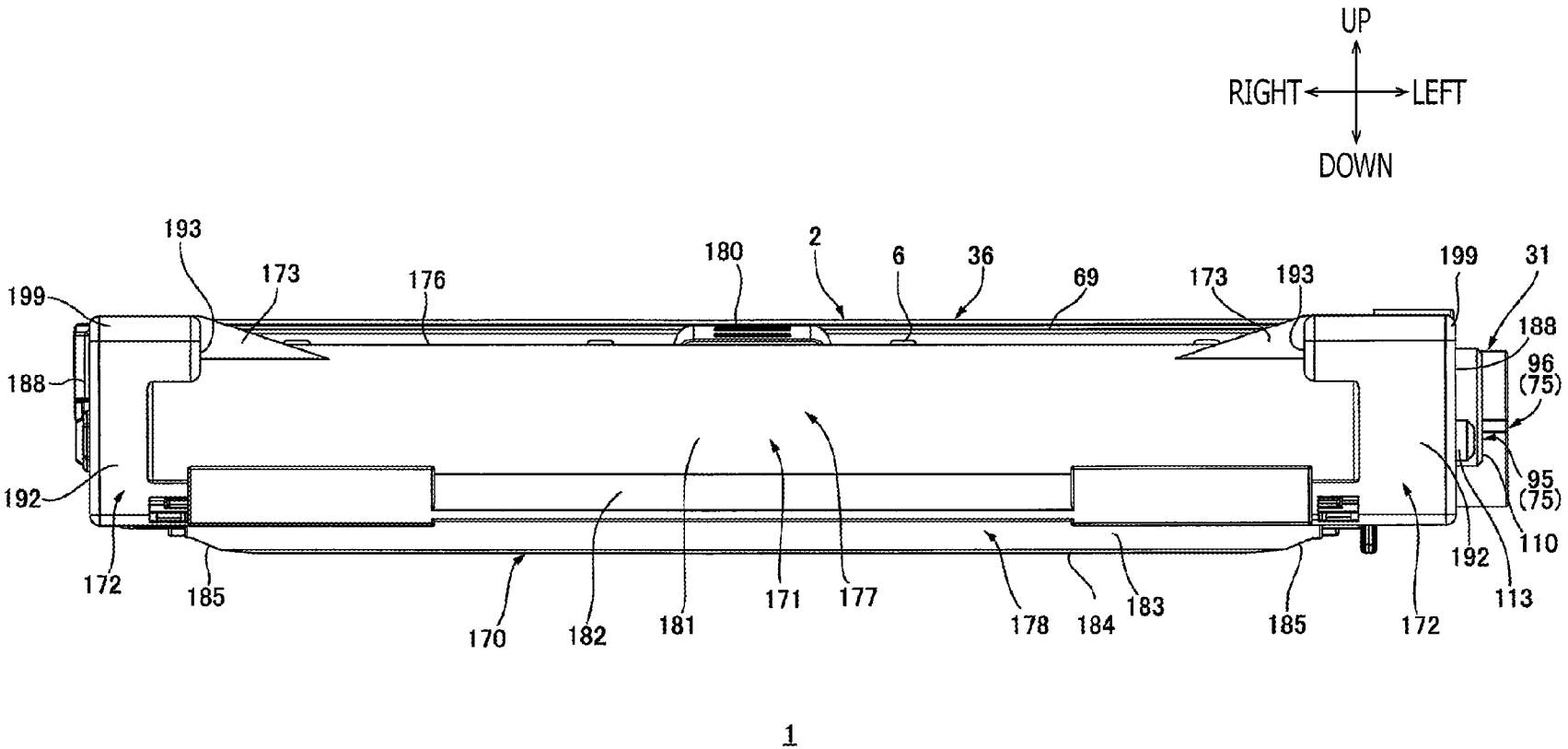
FIG. 7 is a rear view of the developer cartridge shown in FIG. 4, when the developing roller cover is attached, according to the first embodiment.

The inclined ribs 173 are arranged on the right and left sides so as to connect the right and left end portions of the facing part 177 with a pair of protruded parts 199, respectively. Further, the inclined ribs 173 are also arranged in the front-and-rear direction with a certain clearance therebetween. Thus, there are two pairs of the inclined ribs 173. As shown in FIG. 7, each of the inclined ribs 173 is a plate-like part formed to have a substantially triangular shape, viewed from the rear side, which inclines upward toward the outer side. In other words, each of the inclined ribs 173 inclines such that the upper surface thereof becomes farther from the developer frame 2 at a portion on the outer side. The upper end, in the right-and-left direction, of each inclined rib 173 is at substantially the same level of the upper end of the peripheral wall 192 of the side covering part 172.

When the developing roller cover 170 is attached to the developer cartridge 1, the worker firstly grips the main part 171 so as to nip the same from the up and down directions, and move the developing roller cover 170 toward the developer cartridge 1 from the rear side.

Then, the upper covering part 176 is moved forward as guided by the upper surface of the second member 71 of the thickness regulation blade 6, and then located to face the upper surface of the second member 71 in the up-and-down direction, and contacts thereto.

The lower cover 178 is moved along the lower surfaces of the conveying ribs 58, faces the lower surfaces of the conveying ribs 58 in the up-and-down direction and contacts the same. More specifically, a first contact part 183 of the lower cover 178 contacts second surfaces 62 of the conveying ribs 58, while second contact part 184 of the lower cover 178 contacts third surfaces 63 of the conveying ribs 58, thereby the conveying ribs 58 are covered with the lower cover part 178.

When the lower cover part 178 covers the conveying ribs 58, the curved part 181 of the facing part 177 faces the rear end of the developing roller main body 12 with a certain space therebetween, while the planar part 182 of the facing part 177 faces the rear end part of the curved wall of the lower wall 35 with a certain space therebetween.

As shown in FIG. 4, the gear cover exposing part 196 of the side wall 188 receives the collar part 113 and the coupling insertion part 110 as shown in FIG. 4. With above operation, attachment of the developing roller cover 170 to the developer cartridge is completed. At this stage, as shown in FIG. 6, the pair of positioning parts 59 of the lower wall 35 are exposed to outside through the escaping parts 185. With the above operation, attachment of the developing cover 170 to the developer cartridge 1 is completed.

When the developing roller cover 170 is removed from the developer cartridge 1, the processes opposite to the above may be executed. Specifically, the worker may move the developing roller cover 170 so as to pull rearward with holding the gripping part 180. Then, removal of the developing roller cover 170 from the developer cartridge 1 is completed.

As shown in FIG. 4, the side wall 188 of the left side cover 172 overlays, when viewed from the right-and-left direction, only the first gear cover 95 when the developer cover 170 is attached. Therefore, it is possible to remove only the second gear cover 96 of the gear cover 75 from the developer cartridge 1 when the developing roller cover 170 is attached.

Specifically, as shown in FIG. 8, firstly the second screw 160 and the co-fastening screw 161 are screwed out from the left wall 32. Then, it becomes possible to remove the second gear cover 96 from the first gear cover 95. Thus, the worker can remove only the second gear cover 96 from the left wall 32. As above, the second gear cover 96 can be removed from the left wall 32 simply.

When the second gear cover 96 is removed from the left wall 32, the gear train 74 can be removed from the detection gear 81. Then, the cap 38 can be removed from the toner filling mouth 37. When the can 38 is removed from the toner filling mouth 37, the toner filling mouth 37 is exposed. Accordingly, it becomes possible to fill in the toner in the toner chamber 7 through the toner filling mouth 37.

According the developer cartridge 1 described above, as shown in FIG. 5, the developing roller cover 170 is attached to the frame 2 such that the first contacting part 183 contacts the second surfaces 62 of the conveying ribs 62 and the lower covering part 178, and the second contacting part 184 of the lower covering part 178 contacts the third surfaces 63 of the conveying ribs 58.

As the lower covering part 178 of the developing roller cover 170 has a shape extending along the shape of the conveying ribs 58 of the frame 2 and contacts the same, upsizing of the developer cartridge when the developing roller cover 170 is attached can be suppressed.

Further, when the developing roller cover 170 is attached to the developer cartridge 1, the first contacting part 183 contacts the second surfaces 62 and the second contacting part 184 contacts the third surfaces 63, it is suppressed that the developing roller cover 170 damages the conveying ribs 58 due to external impact shock which is applied to the developer cartridge 1 during shipping/conveying and causes the developing roller cover 170 to sag and elastically contact the conveying ribs 58.

As a result, the quality of the conveying ribs can be guaranteed and the sheet P can be smoothly conveyed as guided by the conveying ribs 58 with the developer cartridge 1 is attached to the casing 16.

Further, according to the developer cartridge 1, as shown in FIG. 5, the first contacting part 183 is inclined downward toward the front side, while the second contacting part 184 extends in the front-and-rear direction.

Accordingly, the first contacting part 183 does not pucker toward a direction in which the developing roller cover 170 is attached to the frame 2, that is, toward upward. Thus, the first contacting part 183 smoothly receives the frame 2.

As a result, by moving forward the developing roller cover 170 from the rear side to the front side with respect to the frame 2, the second contacting part 184 can be contacted to the third surfaces 63 with suppressing resistance between the lower covering part 178 and the conveying ribs 58. Thus, the developing roller cover 170 can be attached to the frame 2 easily and securely.

Further, according to the developer cartridge described above, as shown in FIG. 5, the second contacting part 184 of the loser covering part 178 extends in the front-and-rear direction so as to be substantially parallel with the upper covering part 176.

Therefore, the worker can attach the developing roller cover 170 to the frame 2 securely with holding the frame 2. Further, the developing roller cover 170 can easily be removed from the frame 2 by moving the developing roller cover 170 in the front-and-rear direction in which the second contacting part 184 and the upper covering part 176 extend.

According to the developer cartridge described above, as shown in FIGS. 4 and 7, the developing roller cover 170 is provided with the inclined ribs 173, when the developer cartridge 1 attached with the developing roller cover 170 is put into a bag for shipping/conveying, the protruded parts 199 may not be caught by the bag in the right-and-left direction.

Accordingly, the developer cartridge 1 with the developing roller cover 170 attached can be put into bag easily, and thus can be conveyed/shipped with keeping the quality thereof.

According to the illustrative embodiment, the upper ends of the protruded parts 199 is located at a higher level than the upper end of the gripping part 180.

Therefore, it is possible to suppress upsizing of the developer cartridge 1 with the developing roller cover 170 attached although the gripping part 180 to be gripped when the developing roller cover 170 is removed is provided.

According to the illustrative embodiment, the developer cartridge 1 has the inclined wall 69 which is inclined downward toward the gripping part 180. Therefore, when the developing roller cover 170 is removed from the frame 2, the worker can access the gripping part 180 easily. Therefore, the developing roller cover 170 can be removed from the frame 2 easily.

As shown in FIG. 6, the positioning part 59 can be used with the developing roller cover 170 being attached to the developer cartridge 1.

Further, as shown in FIG. 8, the toner filling mouth 37 can be exposed to outside by separating the second gear cover 96 from the first gear cover 95 with the developing roller cover 170 being attached to the developer cartridge 1. As a result, it is possible to fill in the toner inside the frame 2 with the developing roller cover 170 attached to the developer cartridge 1.

Second Embodiment

Figure 9:
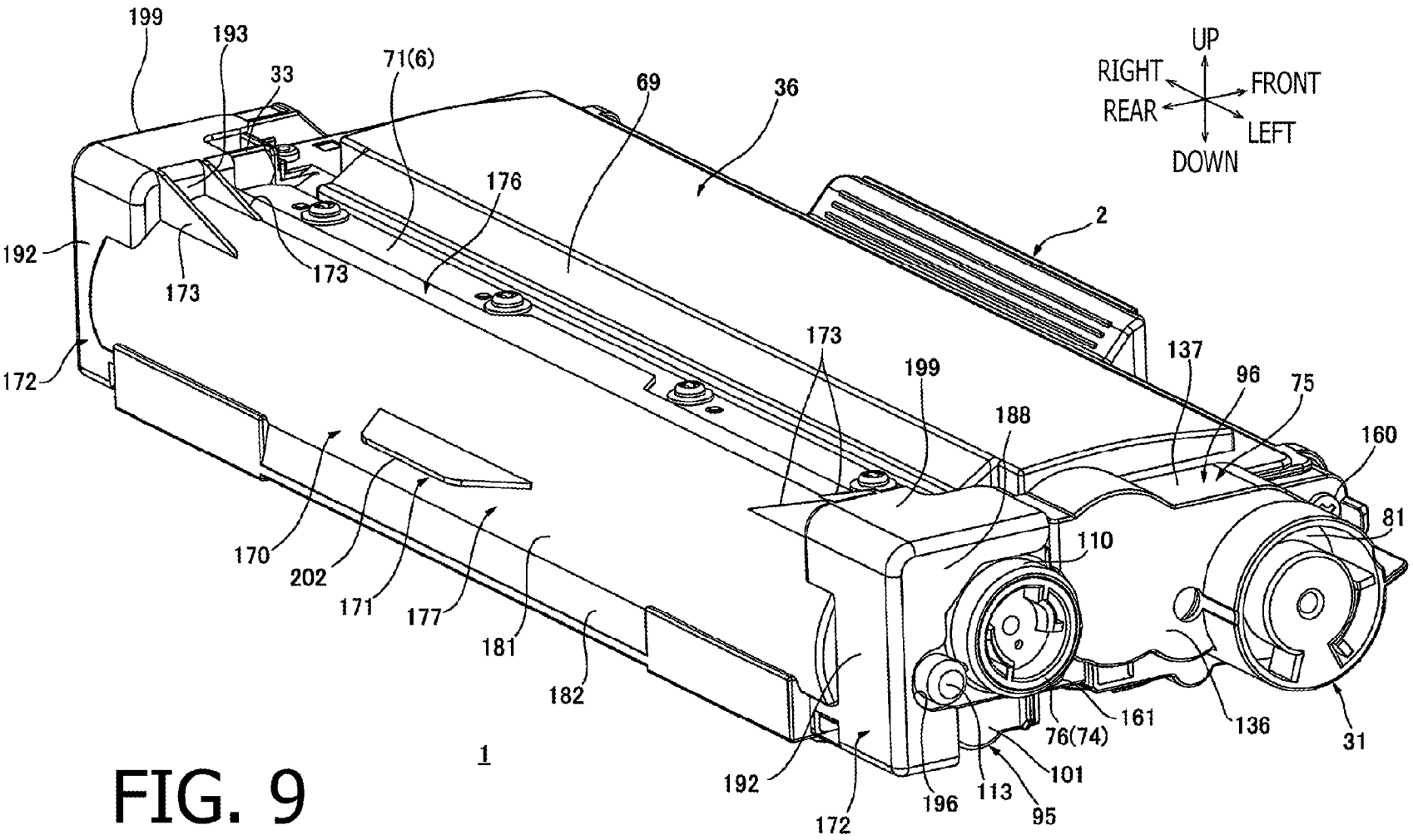
FIG. 9 is a perspective view, viewed from an upper left position, of the developer cartridge when the developing roller cover according to the second embodiment is attached.
Figure 10:
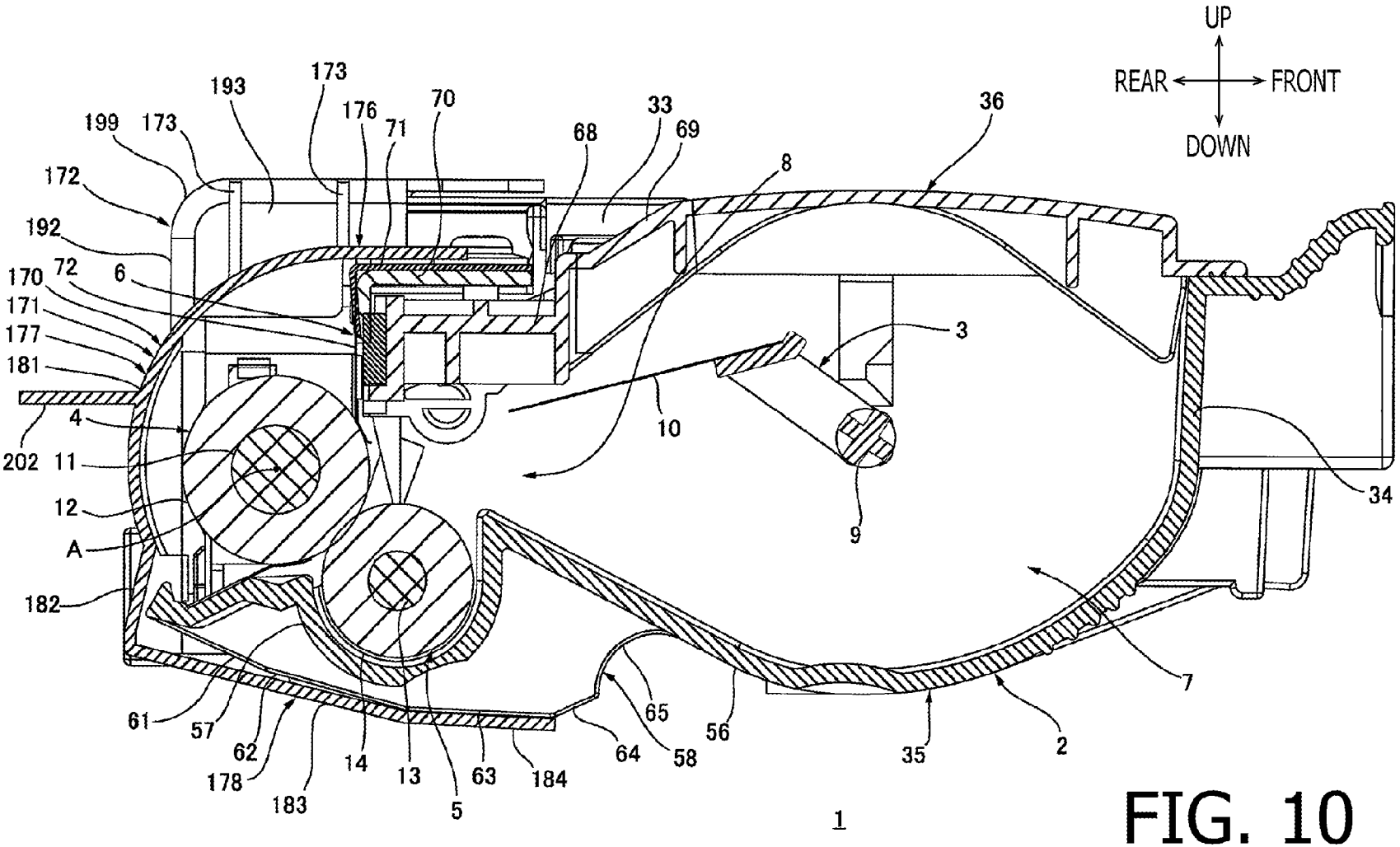
FIG. 10 is a cross-sectional side view of the developer cartridge when the developing roller cover shown in FIG. 9 is attached.

Referring to FIGS. 9 and 10, a developing cartridge according to the second illustrative embodiment will be described. It is noted that the components/members/configurations similar to those of the first illustrative embodiment are assigned with the same reference numbers and description thereof is omitted for brevity.

According to the first illustrative embodiment described above, the upper covering part 176 of the developing roller cover 170 is provided with the gripping part 180 which is inflated upward.

According to the second illustrative embodiment, the curved part 181 of the developing roller cover 170 is formed with a gripping part 202.

The gripping part 202 has a substantially plate-like shape having a rectangular plan view and extending rearward from a substantially central part in the up-and-down and right-and-left direction. Both ends of the gripping part 202 in the right-and-left direction is formed to incline inward in the right-and-left direction toward the rear side thereof as shown in FIG. 9. The gripping part 202 is displaced from the developing roller 4 in the front-and-rear direction when projected in the up-and-down direction.

An operation to attach the developing roller cover 170 from the developer cartridge 1 according to the second illustrative embodiment is similar to the that in the first embodiment.

When the developing roller cover 170 according to the second illustrative embodiment is removed from the developing cartridge 1, the worker grips the gripping part 202 and pulls the same toward the rear direction.

With this operation, removal of the developing roller cover 170 according to the second illustrative embodiment can be completed.

According to the second illustrative embodiment, since the gripping part 202 is arranged so as not to overlap when projected in the up-and-down direction as shown in FIGS. 9 and 10, the worker can grip the gripping part 202 and remove the developing roller cover 170 from the frame 2 without touching the developing roller 4.

Therefore, according to the second illustrative embodiment, in addition to various advantages similar to those of the first illustrative embodiment, the developing roller 4 is prevented from being damaged, and therefore, the quality of the developer cartridge 1 can be maintained.

It is noted that the above described developer cartridges according to the first and second illustrative embodiments are only exemplary embodiments, and various modification can be made without departing from the aspects of the disclosures.

For example, instead of the developing roller 4, another type of rotating body such as a brush roller, a magnetic roller and the like may be employed in a cartridge.

According to the above-described illustrative embodiments, the inclined ribs 173 are arranged on both sides, in the right-and-left direction, of the developing roller cover 170. This configuration may be modified such that the inclined ribs 173 are arranged only one side, in the right-and-left direction, of the developing roller cover 170.

According to the illustrative embodiments, the process cartridge 17 is configured such that the drum cartridge 24 and the developer cartridge 1 are separated. This configuration may be modified such that the drum cartridge 24 and the developer cartridge 1 are configured as an integral component, the entire component may be regarded as a cartridge and the above-described configuration may be applied to the integral component instead of the developer cartridge 1 of the illustrative embodiments. In such a modification, it is further possible to apply the configuration of the developing roller cover to a photoconductive drum cover for covering the photoconductive drum which is partially exposed outside from the integral component.

What is claimed is:

1. A developer cartridge, comprising:

a rotatable body configured to be rotatable about a rotation axis extending in an axial direction and carry developer on a circumferential surface thereof;

a casing configured to rotatably support the rotatable body so that a part of the circumferential surface of the rotatable body is exposed to outside the casing, the casing having a first side and a second side, and being configured to contain the developer therein;

a conveying guide structure protruded from the casing on the first side in a first direction which is perpendicular to the axial direction, the conveying guide structure being configured to guide a sheet medium; and a cover configured to detachably attach to the casing to cover the part of the circumferential surface of the rotatable body, wherein the cover comprises:

a facing part arranged on the first side in a second direction which is perpendicular to both the first direction and the axial direction with respect to the circumferential surface of the rotational body, the facing part facing the rotational body with a predetermined space therebetween, wherein the facing part has a first end and a second end; and a first covering part configured to cover the conveying guide structure from the first side of the first direction, wherein the conveying guide structure comprises:

a first conveying guide extending in the second direction; and a second conveying guide connected from the first conveying guide at an end on the second side of the second direction and extends toward the other side of the second direction so as to curve in the first direction with respect to the first conveying guide, wherein the first covering part comprises:

a first contacting part connected to the first end of the facing part on the first side of the first direction, wherein the first contacting part extends toward the second side in the second direction and contacts the first conveying guide; and a second contacting part connected to the second end, in the second direction, of the first contacting part, wherein the second contacting part curves in the first direction with respect to the first contacting part so as to extend toward the second side in the second direction, and contacts the second conveying guide.

2. The developer cartridge according to claim 1, wherein the first contacting part is inclined toward the first side in the first direction, and wherein the second contacting part extends in the second direction.

3. The developer cartridge according to claim 1, further comprising a second covering part extending toward the second side in the second direction from the second end, in the first direction, of the facing part, the second covering part contacting the cartridge, wherein a direction in which the second covering part extends is substantially parallel with a direction in which the second contacting part extends.

4. The developer cartridge according to claim 3, further comprising a protruded part which protrudes in a direction away from the casing in the first direction with respect to the second covering part; and an inclined rib connected to the second covering part and the protruded part, the inclined rib extending in the axial direction and inclining such that an end surface, which extends in the axial direction, of the inclined rib becomes farther from the casing at a portion closer to the protruded part.

5. The developer cartridge according to claim 4, further comprising a gripping part formed to inflate toward a direction away from the casing along the first direction, wherein the protruded part is protruded in the direction farther away from the casing, along the first direction, than the gripping part.

6. The developer cartridge according to claim 5, wherein the casing is provided with an inclined part which inclines toward the first side in the first direction and from the second side in the second direction toward the gripping part when the cover is attached to the casing.

7. The developer cartridge according to claim 1, wherein the facing part is provided with a gripping part extending therefrom in the second direction, and wherein the gripping part is displaced from the rotational body when projected in the first direction.

8. The developer cartridge according to claim 1, further comprising a positioning part which is used for positioning during a manufacturing process, the positioning part being protruded from the casing toward the first side in the first direction, the positioning part being arranged next to the conveying guide structure in the axial direction, wherein the positioning part is exposed to outside from the first covering part when the cover is attached to the casing.

9. The developer cartridge according to claim 1, further comprising:

a driving gear configured to transmit a driving force to the developing roller; and a gear cover configured to cover the driving gear and the developer filling mouth collectively, wherein the casing has a developer filling opening through which the developer is filled inside the casing;

wherein the gear cover includes:

a first gear cover configured to cover the driving gear; and a second gear cover configured to cover the developer filling opening, and wherein the second gear cover is configured to be separated from the first gear cover so that only the developer filling opening is exposed to outside when the cover is attached to the casing.

10. A developing cartridge, comprising:

a developing roller;

a casing disposed around the developing roller so that a part of the circumferential surface of the developing roller is exposed to outside the casing, the casing being configured to contain developer therein;

a conveying rib protruded from the casing in a first direction, the conveying rib being configured to guide a sheet medium; and a cover configured to detachably attach to the casing to cover the part of the circumferential surface of the developing roller, wherein the cover comprises:

a facing part facing the rotational body with a predetermined space; and a first covering part configured to cover the conveying rib;

wherein the conveying rib comprises:

a first guide; and a second guide connected from the first guide and extends in a second direction which is perpendicular to the axial direction so as to curve with respect to the first guide, wherein the first covering part comprises:

a first contacting part connected to an end of the facing part and contacting a tip of the first guide; and a second contacting part connected the first contacting part, the second contacting part contacting a tip of the second guide, a second contacting part extending in the second direction so as to curve with respect to the first covering part.

11. The developer cartridge according to claim 10,
wherein the first contacting part is inclined toward in the first direction, and
wherein the second contacting part extends in the second direction.

12. The developer cartridge according to claim 10,
further comprising a second covering part extending in the second direction from the second end, in the first direction, of the facing part, the second covering part contacting the cartridge,
wherein the second direction in which the second covering part extends is substantially parallel with a direction in which the second contacting part extends.

13. The developer cartridge according to claim 12,
further comprising
a protruded part protrudes in a direction away from the casing in the first direction with respect to the second covering part; and
an inclined rib connected to the second covering part and the protruded part, the inclined rib extending in the axial direction and inclining such that an end surface, which extends in the axial direction of the inclined rib, becomes farther from the casing at a portion closer to the protruded part.

14. The developer cartridge according to claim 13,
further comprising a gripping part formed to inflate toward a direction away from the casing along the first direction,
wherein the protruded part is protruded in the direction farther away from the casing, along the first direction, than the gripping part.

15. The developer cartridge according to claim 10,
wherein the facing part is provided with a gripping part extending therefrom in the second direction, and
wherein the gripping part is displaced from the rotational body when projected in the first direction.

16. The developer cartridge according to claim 10,
further comprising a boss being protruded from the casing in the first direction, the positioning part being arranged next to the conveying guide in the axial direction,
wherein the boss is exposed to outside from the first covering part.

17. The developer cartridge according to claim 10,
further comprising:
a driving gear configured to transmit a driving force to the developing roller; and
a gear cover configured to cover the driving gear and the developer filling mouth collectively,
wherein the casing has a developer filling opening through which the developer being filled in inside the casing;
wherein the gear cover includes:
a first gear cover configured to cover the driving gear; and
a second gear cover configured to cover the developer filling opening, and
wherein the second gear cover is configured to be separated from the first gear cover so that only the developer filling opening is exposed to outside when the cover is attached to the casing.

* * * * *